US009636695B2

(12) United States Patent
Pravert

(10) Patent No.: US 9,636,695 B2
(45) Date of Patent: May 2, 2017

(54) VENTURI PUMP AND FACILITY FOR APPLYING PAINT COATINGS

(71) Applicant: SAMES TECHNOLOGIES, Meylan (FR)

(72) Inventor: Christophe Pravert, Grenoble (FR)

(73) Assignee: SAMES TECHNOLOGIES, Meylan (FR)

( * ) Notice: Subject to any disclaimer, the term of this patent is extended or adjusted under 35 U.S.C. 154(b) by 30 days.

(21) Appl. No.: 14/784,157

(22) PCT Filed: Apr. 16, 2014

(86) PCT No.: PCT/EP2014/057733

§ 371 (c)(1),
(2) Date: Oct. 13, 2015

(87) PCT Pub. No.: WO2014/170374

PCT Pub. Date: Oct. 23, 2014

(65) Prior Publication Data

US 2016/0052001 A1 Feb. 25, 2016

(30) Foreign Application Priority Data

Apr. 17, 2013 (FR) ..... 13 53485

(51) Int. Cl.
*B01F 5/04* (2006.01)
*B05B 7/14* (2006.01)
(Continued)

(52) U.S. Cl.
CPC ..... *B05B 7/1472* (2013.01); *B05B 5/047* (2013.01); *F04B 53/1075* (2013.01); *F04F 5/14* (2013.01);
(Continued)

(58) Field of Classification Search
CPC ..... B05B 5/047; B05B 7/1472; F04F 5/461; F04F 5/466; F04F 5/24; F04F 5/46; F04F 5/14; F04B 53/1075
(Continued)

(56) References Cited

U.S. PATENT DOCUMENTS 2,072,845 A * 3/1937 Benoit ..... B05B 7/1404 110/104 B
3,493,270 A * 2/1970 Doerfler ..... B01D 17/02 137/493.9
(Continued)

FOREIGN PATENT DOCUMENTS

CN 86207978 U 5/1987
CN 1638875 A 7/2005
(Continued)

OTHER PUBLICATIONS

International Search Report for PCT/EP2014/057733 dated Jun. 13, 2014.
French Search Report for FR 1353485 date Jan. 9, 2014.

*Primary Examiner* — Umashankar Venkatesan
(74) *Attorney, Agent, or Firm* — Pearne & Gordon LLP

(57) ABSTRACT

A Venturi pump used for sucking powder from a supply, diluting the same, then feeding it to a gun via a conveyor pipe. The pump comprises an outer body, at least one powder suction duct, at least two air connections, of which a first air connection is capable of supplying an injector to create a vacuum inside the suction duct and a second air connection is capable of supplying a dilution air circuit separate from the powder flow. The pump including at least one powder outlet nozzle centered on an axis of diffusion, the inlet of which is located downstream from the first air connection and the suction duct. At least one protection barrier contains a non-return valve disposed inside the dilution air circuit and at least one outlet tip of the dilution
(Continued)

circuit disposed around the nozzle and also connected to the conveyor pipe.

16 Claims, 3 Drawing Sheets

(51) Int. Cl.
*B05B 5/047* (2006.01)
*F04B 53/10* (2006.01)
*F04F 5/24* (2006.01)
*F04F 5/46* (2006.01)
*F04F 5/14* (2006.01)

(52) U.S. Cl.
CPC ..... *F04F 5/24* (2013.01); *F04F 5/46* (2013.01); *F04F 5/461* (2013.01); *F04F 5/466* (2013.01)

(58) Field of Classification Search
USPC ..... 137/888
See application file for complete search history.

(56) References Cited

U.S. PATENT DOCUMENTS 5,505,566 A * 4/1996 Gruber ..... B05B 7/1404 137/110
6,547,164 B2 * 4/2003 Miquel ..... F04F 5/461 239/432
6,857,826 B2 * 2/2005 Seitz ..... B05B 7/1472 406/152
6,968,863 B1 * 11/2005 Roffelsen ..... F16K 15/142 137/512.15
7,530,505 B2 * 5/2009 von Keudell ..... B05B 7/10 239/290
7,648,350 B2 * 1/2010 Hinz ..... B60T 8/4031 137/860
2009/0004028 A1 1/2009 Hihn et al.
2016/0215795 A1 * 7/2016 Euzenat ..... F01D 25/20

FOREIGN PATENT DOCUMENTS

CN 1913972 A 2/2007
CN 101142030 A 3/2008
DE 9036799 U 7/1993
EP 0552744 A1 7/1993
EP 0629451 A1 12/1994
EP 0818245 A1 1/1998
EP 0913203 A1 5/1999
EP 1348486 A2 10/2003
EP 1348486 A3 10/2003
EP 2574796 A1 4/2013
FR 2876303 A1 4/2006
GB 898171 A 6/1962

* cited by examiner

VENTURI PUMP AND FACILITY FOR APPLYING PAINT COATINGS

This application is a National Stage application of PCT international application PCT/EP2014/057733, filed on Apr. 16, 2014 which claims the priority of French Patent Application No. 1353485 entitled "VENTURI PUMP AND FACILITY FOR APPLYING PAINT COATINGS", filed with the French Patent Office on Apr. 17, 2013, both of which are incorporated herein by reference in their entirety.

The present invention relates to a powder pump using Venturi technology, in particular used in a method for the electrostatic application of powdered paint coatings. A Venturi pump is a relatively simple and inexpensive member. This member is based on the Venturi effect, which consists of creating a vacuum by injecting high-speed air in order to suction powder from a reservoir that may contain a fluidized powder bed, then conveying it to a pneumatic or electrostatic applicator using a pipe suitable for conveying powder. In order to suction the powder at the base of the reservoir more easily, air is injected inside the reservoir to fluidize the powder. Based on the supply distance between the Venturi pump and the applicator, and the length of the conveyor pipe, which can vary between three and fifteen meters, this type of pump makes it possible to obtain paint flow rates of approximately fifty to five hundred grams per minute.

A Venturi pump most often comprises a powder suction duct submerged in the powder reservoir, an air connection that makes it possible to create a vacuum within the suction duct, and a nozzle that makes it possible to discharge the air/powder mixture inside a conveyor pipe and toward the electrostatic applicator or, more simply, the gun.

In order to allow optimal conveyance in diluted phases without pulses, i.e., to ensure a continuous flow of powder along the entire conveyor pipe, it is known to add, at the pipe, means for injecting an additional so-called "dilution" air downstream from the air and powder mixture, and upstream from the conveyor pipe. A pump of this type is most often supplied by a pneumatic member generating two air circuits, i.e., an "injection" air circuit and a "dilution" air circuit. The pneumatic member regulates the pressure or air flow rate mixed with the powder. Independently of the selected regulating mode, the pneumatic members for supplying injection and dilution air are sensitive to the rises in powder that are observed during the transitional pumping phases or during cleaning phases. It has been observed that the dilution air circuit is significantly more sensitive to these rises in powder. In fact, the latter is sometimes inactive during the pumping phase when the injection air flow rate alone makes it possible to ensure conveyance without pulses. Thus, the dilution air supply circuit is at a relatively zero pressure, while a pressure of several tens of millibars prevails at the outlet of the pump in the mixture to be conveyed. As a result, an inverse stream charged with powder reaches the pneumatic members of the module. Likewise, the cleaning phases also lend themselves to rising powder in the dilution circuit.

In order to resolve this problem, it is known to protect the pneumatic control modules by incorporating protection barriers. These protection barriers may be integrated into the pneumatic module itself, or in the supply circuit, between the module and the pump, or at the injection and dilution air supply connections on the pump. These protection barriers are generally made up of a porous medium or a non-return valve, for example a ball valve or a membrane valve.

The use of a non-return valve housed in the air supply connection makes the connection expensive and bulky. The use of a porous medium offers an effective protection barrier, since the air can flow through the pores of the medium, but the pores are small enough that the power cannot cross through the medium. However, after a certain operating period, the inverse air flow charged with powder results in slowly plugging the pores of the porous medium by incrustation of the grains of powder in the material. This incrustation causes a decrease in the air passage, and therefore a loss of efficiency during pumping. This part needs to be replaced after a certain operating period, which creates an additional maintenance cost for the user. Thus, although the porous medium is inexpensive to manufacture and offers effective protection from dust returns, it is an additional wearing part and causes more expensive maintenance.

The invention more particularly aims to resolve these drawbacks by proposing a Venturi pump provided with an effective protection barrier and not constituting a wearing part.

To that end, the invention relates to a Venturi pump, making it possible to suction a powder from a reserve, dilute it, then convey it to a gun via a conveyor pipe. This pipe comprises an outer body, at least one powder suction duct, at least two air connections, of which a first air connection is capable of supplying an injector to create a vacuum inside the suction duct and a second air connection is capable of supplying a dilution air circuit separate from the powder flow, at least one powder outlet nozzle, centered on an axis of diffusion, the inlet of which is located downstream from the first air connection and the suction duct, at least one protection barrier, disposed inside the dilution air circuit, and at least one outlet tip of the dilution air circuit, disposed around the nozzle and also connected to the conveyor pipe. According to the invention, the protection barrier comprises a non-return valve that radially surrounds the nozzle.

Owing to the invention, the pneumatic air supply members are protected from power returns cost-effectively, since the protection barrier does not constitute a wearing part and therefore does not need to be replaced during the operating period of the Venturi pump.

According to advantageous but optional aspects of the invention, a Venturi pump may incorporate one or more of the following features, considered in any technically allowable combination:

- The non-return valve is a lip seal, radially disposed between the nozzle and the outlet tip.
- Alternatively, the non-return valve comprises a ring bearing an O-ring seal.
- The ring comprises a groove that widens toward the inside radially to the axis of diffusion and that comprises two bevels, between which the sealing gasket is placed in the sealing position of the groove.
- Alternatively, the ring comprises a groove that widens toward the outside radially to the axis of diffusion and that comprises two bevels, between which the sealing gasket is positioned in the sealing position of the groove.
- The sealing gasket has a section with a diameter larger than or equal to the minimum opening of the groove.
- During the passage of air injected upstream, the sealing gasket deforms elastically so as to go from a first position where it seals the groove to a second position where it does not seal the groove.
- The ring comprises a shoulder situated radially inside the seal.
- In its second position, the O-ring bears against the shoulder.
- The ring and the body of the pump are in a single piece.

The outlet tip and the ring are in a single piece.

The nozzle and the ring are in a single piece.

The invention also relates to an installation for applying a powdered coating product, comprising a reservoir, in which the powdered product is fluidized, a pneumatic supply module, supplying an "injection" air circuit and a "dilution" air circuit, a Venturi pump supplied by the pneumatic supply module and conveying the coating product from the reservoir to a gun while the Venturi pump is as previously described.

The invention will be better understood and other advantages thereof will appear more clearly in light of the following description of one embodiment of a Venturi pump according to its principle, provided solely as an example and done in reference to the appended drawings, in which.

Figure 2:
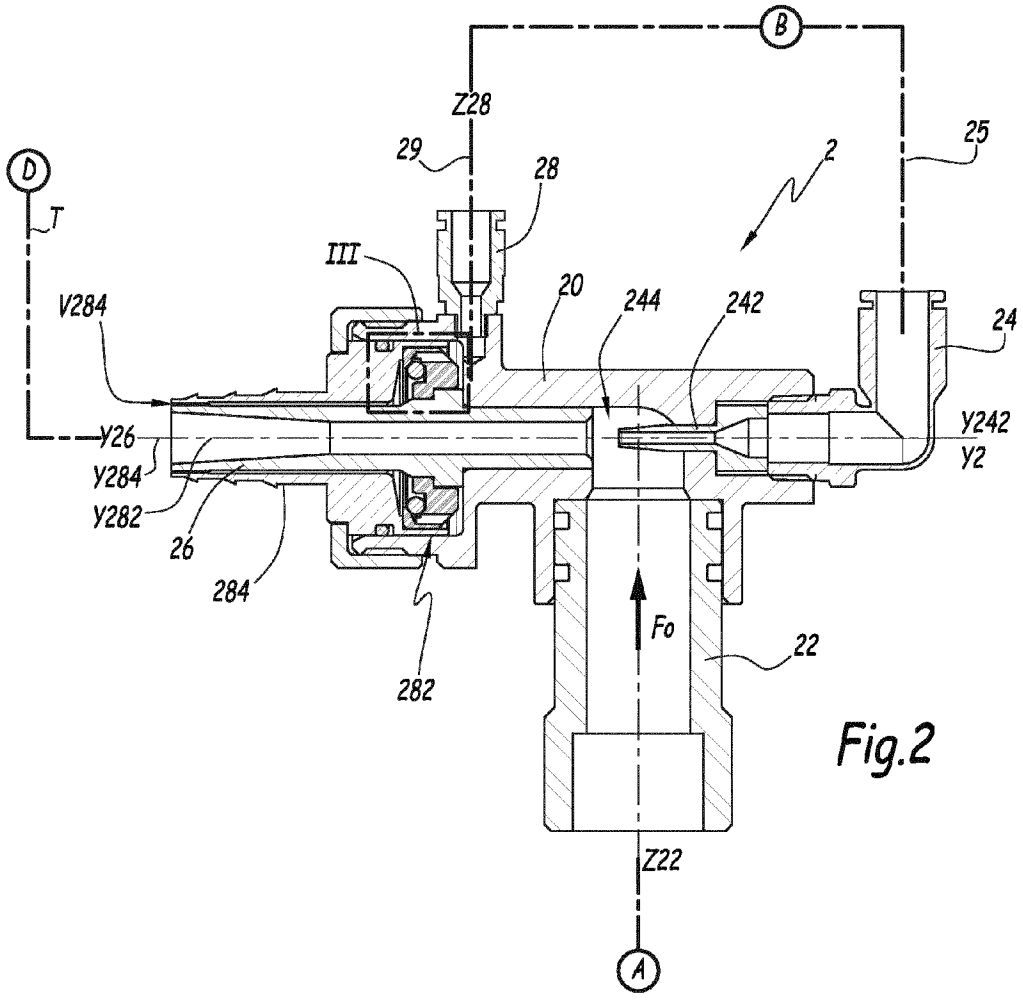
FIG. 2 is a sectional view along line II-II of FIG. 1.
Figure 1:
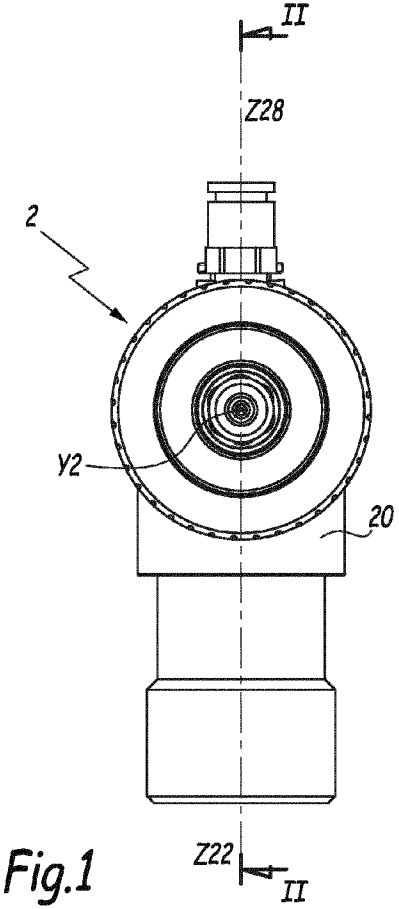
FIG. 1 is a front view of a Venturi pump according to the invention.

FIGS. 1 and 2 show a Venturi pump 2, designed to be used in an installation for applying a powdered paint coating product. The Venturi pump 2 extends along a main axis Y2 and comprises an outer body 20. The outer body 20 includes several openings making it possible to receive different inlet and outlet ducts. The inlet ducts include a first suction duct 22, with a globally cylindrical shape centered on an axis Z22. The suction duct 22 is connected upstream to a reservoir A that is not shown and that contains a fluidized powder bed.

The Venturi pump 2 also includes, at its inlet, a first air injection connection 24. The connection 24 is connected by a duct 25 to a pneumatic supply module B. On the terminal part of the connection 24, an injector 242 is positioned that extends along an axis Y242, the axis Y242 being combined with the axis Y2 previously defined. The injector 242 is situated in the extension of the connection 24, the section of which is narrowed so as to accelerate the air at the end of the connection 24 to create a vacuum at the outlet of the injector 242. This is the Venturi effect. In that case, the injector 242 belongs to the connection 24. Alternatively, the injector 242 and the connection 24 are two different parts. The air injector 242 emerges on a zone 244 situated at the downstream end of the suction duct 22. A vacuum is therefore created in that zone 244, which tends to suction the powder from the reservoir A to the zone 244 in the direction of the arrow $F_o$ in FIG. 2. At the zone 244, the mixing occurs between the air injected by the connection 24 and the powder suctioned in the suction duct 22. The mixture of air and powder is propelled downstream from the connection 24, i.e., along the axis Y242, and from right to left in FIG. 2. The air/powder mixture therefore reaches a nozzle 26 that extends along an axis of diffusion Y26, the axis Y26 and the axis Y242 being combined. The nozzle 26 has a downstream terminal part, i.e., situated on the left side of the nozzle 26 in FIG. 2, with an inner section larger than that of the upstream part, or the right part in FIG. 2. The nozzle 26 therefore assumes the form of a hose. Using a hose form makes it possible to increase the pressure of the air/powder mixture at the outlet. This allows easier conveyance of the air/powder mixture to an electrostatic applicator D, in particular a gun, through the conveyor pipe.

The Venturi pump 2 also includes a second air supply connection 28 at its inlet, centered on an axis Z28 that is perpendicular to the axis Y2. It supplies a dilution air circuit, that dilution circuit V28 being separated from the stream of powder. The injection of the dilution air in the air/powder mixture takes place downstream from the first injection, having taken place upstream via the injector 242. This supply duct 28 is also connected to the pneumatic supply module B by a duct 29. The pneumatic supply module B therefore supplies air to both connections 24 and 28. The connection 24 is a so-called "injection" supply connection, while the supply connection 28 is a so-called "dilution" supply duct. The air injected inside the supply connection 28 passes inside an outlet tip 284. That outlet tip 284 is disposed around and coaxially to the nozzle 26 and outwardly comprises projections: this is therefore called a "tree" connection. The passage of the dilution air is done in an annular manner between the outlet tip 284 and the nozzle 26.

The outlet tip 284 and the nozzle 26 are connected downstream, i.e., on the left in FIG. 2, to a conveyor pipe T that makes it possible to convey the air/powder mixture to the electrostatic applicator or applicator gun D, making it possible to coat a part with paint. The additional air injected into the connection 28 makes it possible to decrease the pulses that may appear during conveyance of the air/powder mixture. These pulses appear if the conveyance speed is not sufficient in the pipe, causing an insufficient conveyance air flow rate. The diameter of the conveyor pipe T is optimized based on the powder flow rate to be provided and conveyance distance to be traveled from the Venturi pump 2 to the electrostatic applicator D.

The volume present between the outlet tip 284 and the nozzle 26 is an annular volume V284 that constitutes a dilution chamber.

In reality, the use of the additional air or dilution air at the connection 28 is optional. Indeed, this supply of dilution air is sometimes deactivated in the pumping phase when the injection air flow rate alone makes it possible to ensure conveyance without pulsations. In that specific case, the pressure that prevails within the volume V284 is substantially equal to the pressure at the outlet of the nozzle 26, which is approximately several millibars. This pressure is a consequence of the air/powder flow downstream from the conveyor pipe. On the side of the pneumatic supply module B, the duct 29 is at zero pressure when the dilution supply is deactivated. At its other end, the duct 29 is subject to a pressure substantially equal to that prevailing in the volume V284. Thus, part of the air/powder mixture may reach the pneumatic supply module B.

That is why the dilution air circuit is significantly more sensitive to rises in powder. In order to protect the pneumatic supply module B from rises in powder, the Venturi pump 2 further comprises a non-return valve 282. This non-return valve 282 ensures the passage of the air freely from upstream to downstream, i.e., from the supply duct 28 to the outlet tip 284, on the one hand, and the blockage of the air/powder mixture in the opposite direction, on the other hand. In order to stop the infiltration of the air/powder mixture inside the dilution air circuit V28 as closely as possible, the non-return valve 282 is positioned as close as possible to the outlet of the air/powder mixture. Given that it is impossible to position this non-return valve 282 in the "tree" connection, it has been chosen to position it directly at the outlet of the supply duct 28. The non-return valve 282 has a globally annular shape and is advantageously positioned coaxially around the nozzle 26. Thus, the air injected in the dilution circuit is distributed homogenously in the dilution chamber V284 and the mixture of that dilution air with the powder, at the outlet of the nozzle 26, is improved as a result.

Figure 3:
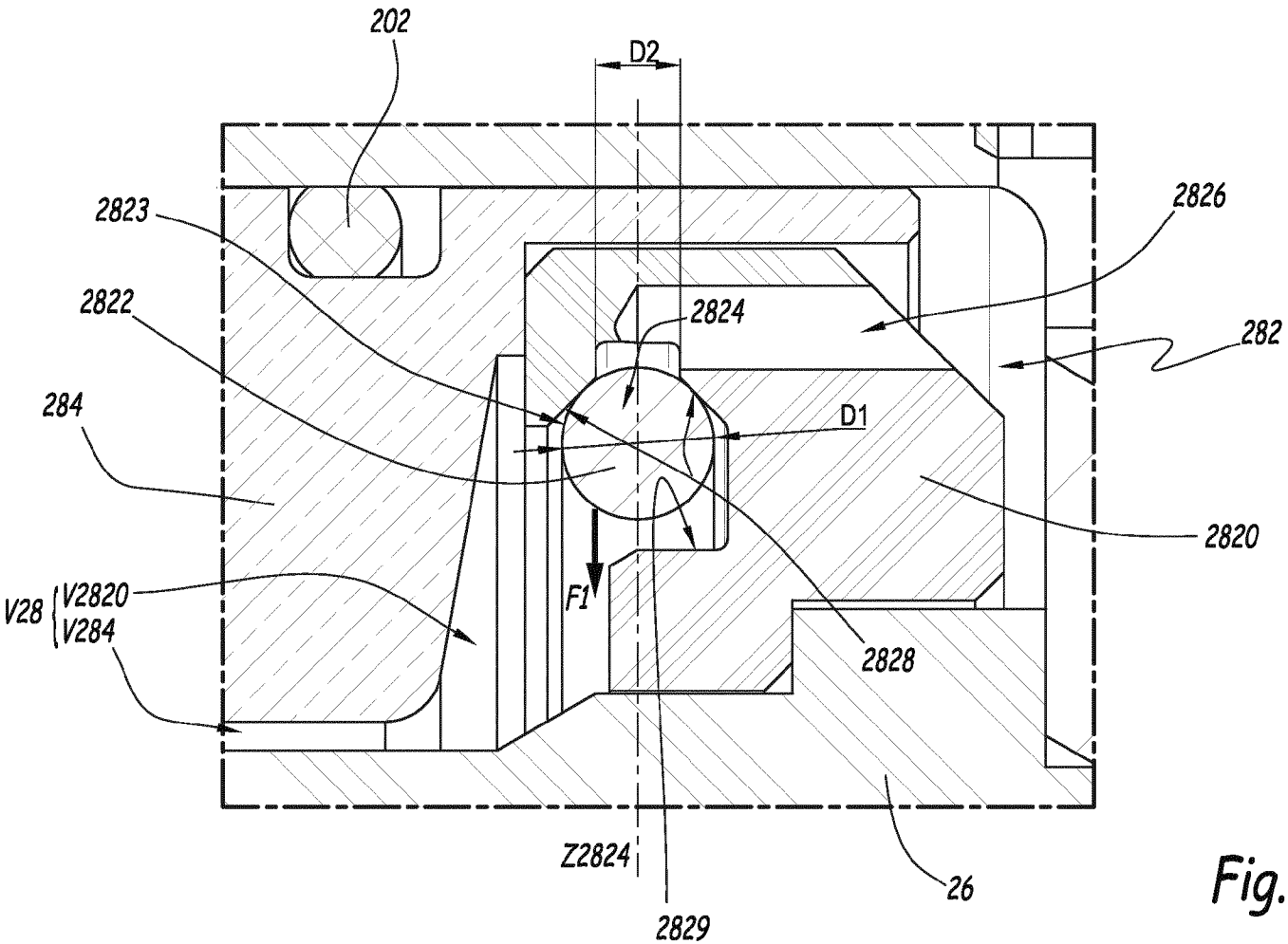
FIG. 3 is an enlarged view of box III of FIG. 2.

More specifically and as shown in FIG. 3, the non-return valve 282 comprises a seal-carrier ring 2820 and a sealing gasket 2822. A volume V2820 is defined as the air passage volume from the pneumatic module P to the dilution chamber V284. This volume in particular includes the channels 2826 for the passage of the air in the valve 282 and the groove 2824. Thus, the dilution air circuit V28 is formed by the dilution chamber V284 and the volume V2820 corresponding to the volume used by the air upstream from the dilution chamber V284. The ring 2820 comprises several channels 2826 for the passage of air, one of which is shown in FIG. 3. These channels 2826 are installed at the outlet of the supply duct 28, extending parallel to the diffusion axis Y26 and emerging on a groove 2824 formed by two bevels 2828. The channels 2826 emerge on the narrowest part of the groove, i.e., where the gap between the bevels 2828, considered parallel to the axis Y26, is the smallest. In other words, the channels 2826 are positioned radially to the axis Y26, outside the groove 2824. The groove 2824 extends over the entire periphery of the seal-carrier ring 2820, while the air passage channels 2826 are regularly distributed around the axis of diffusion Y26. This allows an injection of air that is homogenous in the groove 2824 and in the dilution chamber V284. The groove 2824 becomes wider, radially to the axis Y26, i.e., along a central axis Z2824, toward the inside. The two bevels 2828 are positioned symmetrically relative to the central axis X2824 and are inclined by an angle of approximately 45° relative to the central axis. A sealing O-ring 2822 is disposed between the two bevels 2828. The sealing gasket 2822 has an annular section whereof the diameter D1 is larger than the minimum opening distance D2 of the groove 2824. Thus, the seal 2822 is able to seal the groove 2824.

The air injected in the passage 2826 tends to compress the sealing gasket 2822 in a direction radial to the axis Y26 and oriented inward. This direction is shown by arrow F1 in FIG. 3.

Figure 4:
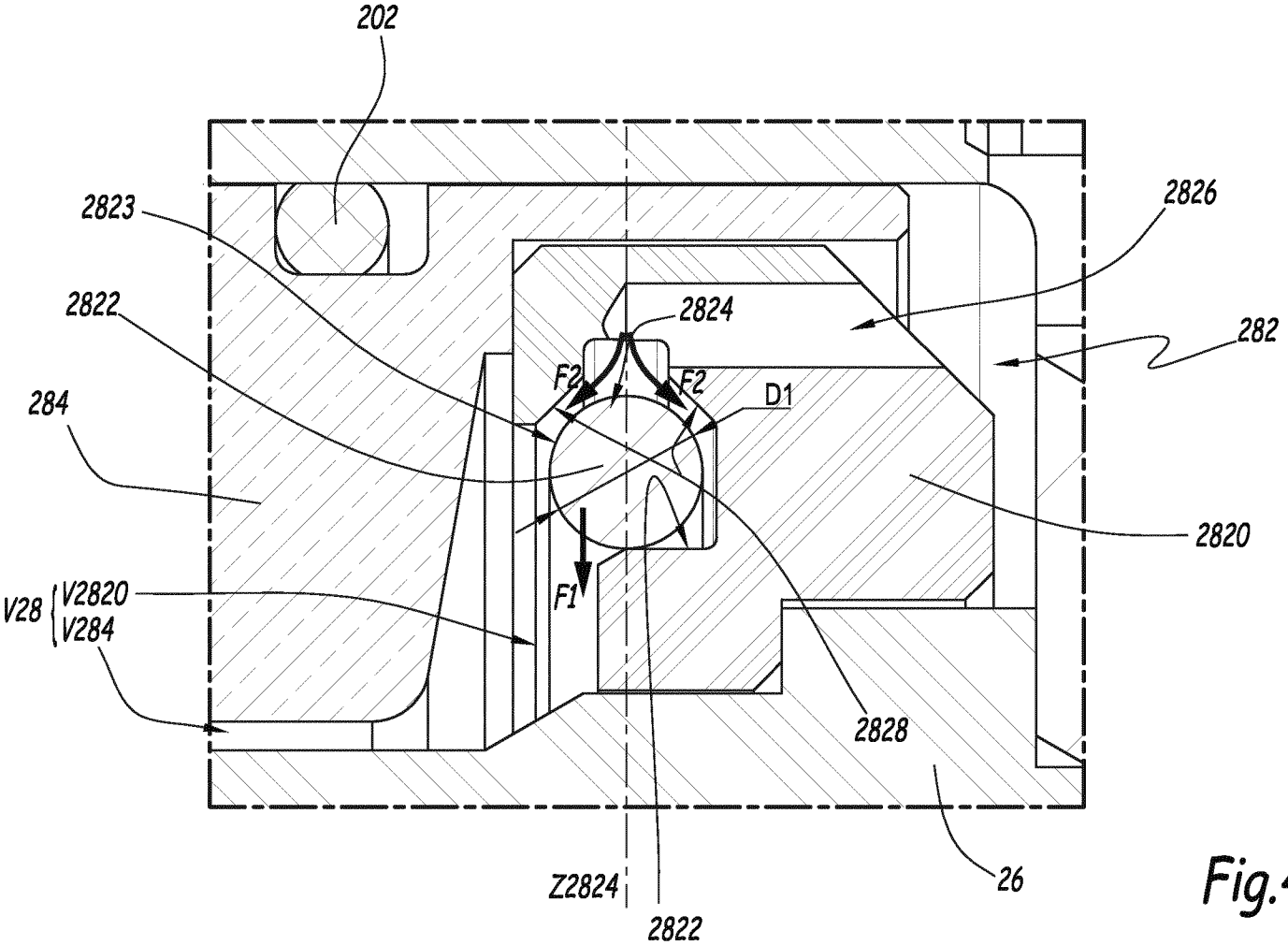
FIG. 4 is a view similar to FIG. 3 when a sealing gasket of the pump is in a second position different from that shown in FIG. 3.

In order to limit the compression of the O-ring 2822 and prevent it from coming out, a shoulder 2829 is provided in the ring 2820 and is radially situated inside the sealing O-ring 2822. During the passage of the air injected upstream, the sealing gasket therefore deforms elastically to go from a first position shown in FIG. 3, where it seals the groove 2824, to a second position shown in FIG. 4, where it optionally bears against the shoulder 2829 of the ring. In fact, in the event the air pressure at the inlet is too low, the seal is radially compressed, but does not reach the shoulder 2829. The air can, however, flow along the bevels 2828, as shown by arrows F2 in FIG. 4.

Conversely, assuming that an air/powder mixture arrives in the opposite direction, i.e., from left to right in FIG. 3, the sealing gasket 2822 is expanded, i.e., pressed against the bevels 2828, and seals the groove 2824. The non-return valve 282 is designed such that it includes as few powder retention zones as possible. Furthermore, the valve 282 is cleaned simply during passage of the dilution air, since the entire seal is bathed by the stream of air.

Indeed, a rise of powder from the nozzle 26 in the dilution chamber V284, and even up to the O-ring 2822, causes powder residue to be deposited on the wall of the valve and the seal. When the dilution air is injected, the air tends to sweep these powder residues in the downstream direction. This self-cleaning function is particularly advantageous, since one avoids a maintenance operation consisting of disassembling and cleaning the non-return valve 282. Unlike the valves of the prior art, the non-return valve 282 therefore does not constitute a wearing part of the pump 2.

The valve 282 is advantageously disposed coaxially to the nozzle 26, and the compressible volume V284 that separates the valve 282 from the powder outlet is thus limited. This makes it possible to facilitate cleaning of the dilution chamber V284 on the one hand, and to limit infiltrations of the air/powder mixture arriving at the outlet of the nozzle 26 in the volume V284 on the other hand.

The outlet tip 284 is made from a generally electrically conductive material and caps the nozzle 26 up to its downstream end. Thus, the outlet tip 284 is practically unusable and allows part of the triboelectric charges present on the nozzle 26 to flow. The powder passage ducts, i.e., the suction duct 22 and the nozzle 26, are made from an appropriate plastic material, so as not to polymerize the powder in contact therewith.

During the connection between the conveyor pipe T and the outlet of the pump 2, made up of the nozzle 26 and the outlet tip 284, the dilution air is therefore added to the mixture of air and powder injected upstream. The flow rates of injection air and dilution air are combined and form a total air flow rate for conveyance of the powdered coating product. A proper adjustment of the conveyance air flow rate makes it possible to guarantee conveyance without pulses, i.e., without jumps and at a constant flow rate. In this way, the application of the powdered coating product is done in a uniform manner. A seal 202 ensures sealing of the dilution air supply duct relative to the outside.

As an alternative that is not shown, the seal-carrier ring 2820 and the body 20 of the pump 2 are in a single piece. The ring 2820 can also be incorporated into the outlet tip 284 or the nozzle 26.

The non-return valve 282 can be mounted fixed or removably on the pump 2.

According to another alternative, it is possible to consider using a lip seal, integrated directly into the dilution chamber, and the lip of which preferably deforms in one direction only. The deformation direction of the lip is that of the passage of the dilution air. It is this unilateral deformation of the lip that performs the non-return function.

According to another alternative, the installation comprising the Venturi pump 2 uses an applicator gun that is not electrostatic, for example of the pneumatic type.

According to another alternative, there is only one air passage channel 2826 that has an annular shape in the seal-carrier ring 2820.

According to another alternative, the groove 2824 becomes wider, radially to the axis Y26, toward the outside. Thus, the channels 2826 are positioned, radially to the axis Y26, inside the groove 2824 and emerge on the narrower part of the groove 2824. During the injection of air upstream, the seal 2822 is therefore radially expanded in order to allow air to pass in the groove 2824.

The alternatives and embodiments described above can be combined to provide new embodiments of the invention.

The invention claimed is:

1. A Venturi pump, making it possible to suction a powder from a reserve, dilute it, then convey it to a gun via a conveyor pipe, said pump comprising:

an outer body, at least one powder suction duct, at least two air connection, of which a first air connection is capable of supplying an injector to create a vacuum inside the suction duct and a second air connection is capable of supplying a dilution air circuit separate from the powder flow, at least one powder outlet nozzle, centered on an axis of diffusion, the inlet of which is located downstream from the first air connection and the powder suction duct, at least one protection barrier, disposed inside the dilution air circuit, and at least one outlet tip of the dilution air circuit, disposed around the powder outlet nozzle and also connected to the conveyor pipe, wherein the protection barrier comprises a non-return valve (282) that radially surrounds the powder outlet nozzle (26).

2. The pump according to claim 1, wherein the non-return valve is a lip seal, radially disposed between the nozzle and the outlet tip.

3. An installation for applying a powdered coating product, comprising:

a reservoir, in which the powdered product is fluidized, a pneumatic supply module, supplying an "injection" air circuit and a "dilution" air circuit, a Venturi pump supplied by the pneumatic power module and conveying the coating product from the reservoir to a gun, wherein the Venturi pump is a pump according to claim 1.

4. The pump according to claim 1, wherein the non-return valve comprises a ring bearing an O-ring seal.

5. The pump according to claim 4, wherein the ring comprises a groove that widens toward the outside radially to the axis of diffusion and that comprises two bevels, between which the O-ring seal is positioned in a sealing position of the groove.

6. The pump according to claim 4, wherein the ring and the outer body of the pump are a single piece.

7. The pump according to claim 4, wherein the outlet tip and the ring are a single piece.

8. The pump according to claim 4, wherein the powder outlet nozzle and the ring are a single piece.

9. The pump according to claim 4, wherein the ring comprises a groove that widens toward the inside radially to the axis of diffusion and that comprises two bevels, between which the O-ring seal is placed in the sealing position of the groove.

10. The pump according to claim 9, wherein the O-ring seal has a section with a diameter larger than or equal to a minimum opening of the groove.

11. The pump according to claim 10, wherein, during the passage of air injected upstream, the O-ring seal deforms elastically so as to go from a first position, where the O-ring seal seals the groove to a second position where the O-ring seal does not seal the groove.

12. The pump according to claim 9, wherein during the passage of air injected upstream, the O-ring seal deforms elastically so as to go from a first position (FIG. 3) where the O-ring seal seals the groove to a second position (FIG. 4) where the O-ring seal does not seal the groove.

13. The pump according to claim 10, wherein the O-ring seal has a section with a diameter larger than or equal to a minimum opening of the groove.

14. The pump according to claim 4, wherein the ring comprises a shoulder situated radially inside the O-ring seal.

15. The pump according to claim 14, wherein the ring comprises a shoulder situated radially inside the O-ring seal and wherein, in its second position, the O-ring seal bears against the shoulder.

16. The pump according to claim 15, wherein the ring comprises a shoulder situated radially inside the O-ring seal and wherein, in its second position, the O-ring seal bears against the shoulder.

* * * * *